US007438975B2

(12) United States Patent
Willemsen et al.

(10) Patent No.: US 7,438,975 B2
(45) Date of Patent: Oct. 21, 2008

(54) ARAMID FILAMENT YARN PROVIDED WITH A CONDUCTIVE FINISH

(75) Inventors: Stephanus Willemsen, Rheden (NL); Harmannus Aaldrik Maria Stuut, Arnhem (NL)

(73) Assignee: Teijin Aramid B.V., Arnhem (NL)

( * ) Notice: Subject to any disclaimer, the term of this patent is extended or adjusted under 35 U.S.C. 154(b) by 640 days.

(21) Appl. No.: 10/541,244

(22) PCT Filed: Dec. 6, 2003

(86) PCT No.: PCT/EP03/13855

§ 371 (c)(1),
(2), (4) Date: Aug. 16, 2005

(87) PCT Pub. No.: WO2004/061196

PCT Pub. Date: Jul. 22, 2004

(65) Prior Publication Data

US 2006/0105168 A1 May 18, 2006

(30) Foreign Application Priority Data

Jan. 2, 2003 (EP) ..... 03000120

(51) Int. Cl.
*D02G 3/00* (2006.01)

(52) U.S. Cl. ..... 428/375; 428/378

(58) Field of Classification Search ..... 428/375, 428/378, 395

See application file for complete search history.

(56) References Cited

U.S. PATENT DOCUMENTS

| | | | | | |
|---|---|---|---|---|---|
| 4,557,967 | A | * | 12/1985 | Willemsen et al. | 442/187 |
| 4,652,488 | A | * | 3/1987 | Willemsen et al. | 442/187 |
| 5,139,873 | A | | 8/1992 | Rebouillat | |
| 5,264,251 | A | * | 11/1993 | Geursen et al. | 427/389.9 |
| 5,270,113 | A | | 12/1993 | Rebouillat | |
| 5,298,028 | A | | 3/1994 | Hsu | |
| 5,342,686 | A | * | 8/1994 | Guersen et al. | 428/328 |
| 5,478,648 | A | | 12/1995 | Stein et al. | |
| 5,534,304 | A | * | 7/1996 | Geursen et al. | 427/389.9 |
| 5,674,615 | A | * | 10/1997 | Neuert et al. | 428/395 |
| 5,834,942 | A | | 11/1998 | De Angelis | |
| 6,319,558 | B1 | * | 11/2001 | Willemsen | 427/389.8 |
| 2006/0105168 | A1 | * | 5/2006 | Willemsen et al. | 428/357 |

FOREIGN PATENT DOCUMENTS

| | | | |
|---|---|---|---|
| EP | 416486 | | 3/1991 |
| EP | 423703 | | 4/1991 |
| EP | 1454074 | A1 * | 7/2004 |
| WO | WO 92/15747 | | 9/1992 |
| WO | WO 97/48832 | | 12/1992 |
| WO | WO 93/25748 | | 12/1993 |

* cited by examiner

*Primary Examiner*—N Edwards
(74) *Attorney, Agent, or Firm*—Oliff & Berridge, PLC

(57) ABSTRACT

The invention pertains to an aramid filament yarn provided with a finish comprising >1.5 wt. % of an organic substance with a conductivity of >4 mS/cm, measured as a 50 wt. % finish composition in water at 20° C., having a specific electric resistance of the yarn $<2.5\cdot10^4$ Ohm·cm, and to a method of making said yarn. Further, the invention pertains to the use of said finish for making conductive cables, particularly for making elevator cables.

19 Claims, No Drawings

ARAMID FILAMENT YARN PROVIDED WITH A CONDUCTIVE FINISH

BACKGROUND

The invention pertains to an aramid filament yarn provided with a conductive finish, to a method of making such yarn, to the use of said yarn and to a cable comprising said yarn.

A common problem of yarns is breaking of the yarn when used in certain applications. Yarn breaks may occur as a result of over-loading, fatigue, or wear. Ground cable damage may also occur as a result of damage caused by rodents. In elevator cables breakage of cables is a serious safety problem. It is known to add, for example, one or more carbon yarns or metal wire to aramid reinforced elevator cables as a break detector. Such treated, aramid reinforced cables, however, do not have the same mechanical characteristics as cables made of untreated aramid yarns only. Moreover, the breaking characteristics of such carbon yarn or metal wire is different from the breaking characteristics of aramid yarn, thereby hampering accurate indication of breaking danger of the aramid reinforced cable. The other mechanical properties of non-aramid yarns in comparison to the main reinforcing material of the cable complicates the predictability of a cable breakage considerably. It would be an advantage to provide aramid yarn having sufficient conductive properties and nevertheless having the same mechanical characteristics as the untreated aramid yarns in the cable.

Some solutions to the above problems are proposed. In WO 9748832, the yarn was coated with a metal such as nickel and an acid. Such treatment provides metalized yarns, the fiber surfaces of which may be damaged by the acid treatment, leading to a decrease of tenacity and/or elongation properties. In WO 9325748, a process was disclosed for treating aramid fibers with a dispersion of particulate graphite material in a swelling solvent. This method also bears the risk of damaging the fiber surface. Moreover, both methods are very complicated, time consuming, and therefore costly.

Aramid fibers and yarns with an antistatic finish are also known in the art. In U.S. Pat. No. 5,478,648, aramid fibers with a spin finish are disclosed having useful properties for making sheet material. These fibers contain an antistatic finish based on phosphoric and/or phosphonic esters, but are not disclosed to have extremely low specific electric resistance, such as $<2.5\cdot10^4$ Ohm·cm. Similarly, U.S. Pat. No. 5,674,615 describes finished aramid fibers for textile sheet materials, which are not reported to have extremely low specific electric resistance. In EP 416,486, finished aramid fibers of relatively high specific electric resistance have been disclosed for use in reinforcing elastomeric and plastic materials. In WO 9215747, aramid fibers have been disclosed which are treated with an antistatic coating. These can be used for reinforcing belts, ropes optical cables, rubber, and composites. The cables herein disclosed are not reported to have extremely low specific electric resistance or to be suitable for use as breaking detector in elevator cables.

SUMMARY

The present invention therefore provides a solution to the above problems, using a simple procedure that is not time consuming, is cheap, and is without any risk of damaging the fibers. Further, the present disclosure provides finished fibers with extremely low specific electric resistance, particularly useful as a breaking detector in elevator cables. It was found that an aramid filament yarn provided with a finish comprising >1.5 wt. % of an organic substance with a conductivity of >4 mS/cm, measured as a 50 wt. % finish composition in water at 20° C., having a specific electric resistance of the yarn $<2.5\cdot10^4$ Ohm·cm, possesses a sufficient conductivity to be used as a breaking detector, without affecting its mechanical properties. This is a substantial advantage over the use of, for example, a carbon yarn or a metal wire as a break detector in aramid reinforced elevator cables, for instance as those which are known from U.S. Pat. No. 5,834,942. The conductivity of the organic substance treated and damaged yarn is reduced as a result of breaks caused by wear or fatigue and provides information to the user on the remaining lifetime of the cable. The conductivity of a yarn or a cable can be determined with a resistancy or multimeter.

When finishes comprising a conductive organic substance (COS) are applied onto aramid filament yarn, the electrical yarn resistance thereof is reduced. Depending on the amount of finish and on the conductivity of the applied organic substance, the treated yarn can be used as such, or in combination with untreated aramid filament yarn as an early break detector in (elevator, bearer, ground) cables, or as a consequence of its low electric resistance for accessories (brushes, rollers) which have to lay on or to eliminate static electricity in, for example, record players, magnetic tapes, compact disks, and the like.

The conductive organic substance can be applied onto wet or dried yarn as a spin-finish (before or after the drying, as such or diluted with a solvent such as water) in the spinning process or in a separate process step at a relatively high yarn speed.

DETAILED DESCRIPTION OF EMBODIMENTS

Aramid filament yarns treated with >2 wt. % of a conductive organic substance (COS) with a conductivity of >30 mS/cm are preferred. More preferred are yarns treated with >2 wt. % of a conductive organic substance (COS) with a conductivity of >41 mS/cm. The specific electric resistance of the yarn is preferably $<2\cdot10^3$ Ohm·cm, more preferably $<10^3$ Ohm·cm. Particularly suitable amounts of COS are within the range 3 to 12 wt. %, more preferably within the range 4-9 wt. %. The wt. % is relative to the total weight of the yarn without finish.

Suitable organic substances that are suitable for use herein are salts or materials having statically chargeable acid or base groups. Materials with acid groups have preferably carboxylate, phosphonate or sulfonate groups. Materials with base groups have preferably amine groups.

Particularly preferred materials are fatty acids, carbonic acids, (cyclo)alkyl phosphates, (cyclo)alkyl phosphonates, (cyclo)alkyl sulfates, (cyclo)alkyl sulfonates, imidazoline derivatives and polymers such as poly(diallyldimethylammonium chloride), and the like.

The aramid yarns preferably are made of poly(p-phenylene terephthalamide) (PPDT), but may also contain minor amounts of other monomers.

The COS is applied onto the yarn by conventional methods known in the art. In embodiments, the COS can be applied in solution. The solvent may be any suitable solvent, such as alcohol, ether, tetrahydrofuran, acetone, benzene, toluene, ethyl acetate, dichloromethane and the like. Most preferably the COS is applied as an aqueous solution. Some COS's are purchased as a water-containing product that can be applied as such.

The suitable amount of COS to be applied can very easily be determined by a simple conductivity measurement, which is known in the art. When the conductivity of the COS or the solution of the COS is determined, a skilled person can easily apply the required amount of finish as needed for the specific use.

The invention also pertains to the use of these yarns in cables and to cables comprising said yarns. These cables have the same mechanical characteristics as cables made of the untreated aramid yarns. This disclosure is particularly useful in elevator cables, which commonly contain a breaking detector of a different material, such as carbon fiber, leading to cables with altered mechanical properties. The present disclosure allows the production of cables, especially elevator cables, of similar yarn, i.e., consisting of untreated yarn and the same or similar yarn treated with the finish according to the invention.

Procedure for the Determination of the Conductivity of a Finish

A suitable procedure to determine the conductivity of a finish composition according to the invention is as follows.

A sufficient amount of the aqueous finish solution (50 wt. % of water and 50 wt. % of COS) to be tested is poured into a beaker. Subsequently, the conductivity of this solution is determined according DIN norm 38404 Teil 8 (9/1985) at a temperature of 20° C.

When the finish containing the COS has a lower or higher water content than 50 wt. %, the concentration of the finish solution should be adjusted to 50 wt. % by the addition of demineralized water or the evaporation of water by heating on a hot plate while stirring at an elevated temperature below 100° C. For the measurement of the conductivity, a conductivity meter type LF 537 of the Wissenschaftlich-Technische Werkstätten GmbH, Weilheim, Germany was used.

The water content of the finish solution was determined by the Karl Fischer method. An exact description of the determination of water via Karl Fischer reagent is given in "Karl Fischer Titration, Methoden zur Wasserbestimmung" by Eugen Scholz, Springer-Verlag 1984.

Procedure for the Determination of the Specific Electrical Resitance

For the determination of the specific electrical resistance of the aramid yarns a sample-holder consisting of two copper bars separated by two polytetrafluorethylene rods was used. The mutual distance of the bars is 52 mm. The yarn to be tested is wound a number of times (preferably between 3 and 7) times around the two copper bars which are connected with a DC high voltage power source and a Keithley electrometer. With the Keithley electrometer the electrical current was determined after a voltage of 500 V was applied over the copper bars at 20° C. and 65% relative humidity. The specific electrical resistance of the yarn was calculated based on Ohm's law, the yarn length between the copper bars, the number of yarn connections, and the cross-section area of the yarn.

The invention is further illustrated with the following non-limitative examples.

EXAMPLE 1

This example illustrates the procedure of applying a finish containing a conductive organic substance (COS) to a wet, not previously dried, yarn in an operation integrated with the spinning process. A spinning mass was prepared by mixing concentrated (99.8 wt. %) sulfuric acid snow with powdered poly-p-phenylene terephthalamide. The spinning mass was de-aerated, heated to 90° C. in a double-screw extruder and fed to a spinneret via a filter and a spinning pump. The spinneret had 1000 orifices of 59 micrometer in diameter. The spinning mass was extruded through the spinning orifices and thereafter successively passed through an air zone of 8 mm in length and a coagulation bath. This bath was a dilute solution of sulfuric acid in water (about 19% by weight) having a temperature of 5° C. The filament bundle thus formed successively passed through a neutralization bath containing a dilute sodium carbonate solution and a washing bath in which the filaments were thoroughly washed with water of about 75° C. Excess adhering water was removed with the aid of a squeeze roller pair. Next, the non-dried bundle of filaments was provided with an aqueous finish containing a COS with the aid of a liquid applicator and a feed pump. Next, the yarn was passed over a series of 3 drying drums (6 wraps of 160° C., 6 wraps of 180° C., 4 wraps of 200° C.). The yarn was in contact with the surface of the drums for 5-6 seconds in all. Subsequently, the yarn was passed over a transport drum (4 wraps of about 20° C.) and was wound into a package at a speed of 400 m/min. The yarn obtained had a linear density of 1610 dtex. The following process conditions were varied (table A and B):

a) the composition of the finish containing the COS b) the amount of COS on the yarn.

TABLE A

Aqueous finishes containing conductive organic substances.

| | Finish composition code | | | |
|---|---|---|---|---|
| | a1 | b1 | c1 | d1 |
| Finish concentration in wt. % | 20 | 20 | 20 | 20 |
| COS in solution (%) | | | | |
| Afilan V4855 (37.6%) | 53.2 | 37.2 | | |
| Afilan PTU | | 6.0 | | |
| PolyDADMAC (42.4%) | | | 47.1 | |
| Tallopol ACF (50.5%) | | | | 39.6 |
| Demineralized water | 46.8 | 56.8 | 52.9 | 60.4 |

Afilan V4855 is an alkane phosphonate, potassium salt, available from Clariant GmbH, Frankfurt, Germany Afilan PTU is an ethoxylated and propoxylated oleic acid, CH3-capped, available from Clariant GmbH, Frankfurt, Germany.

PolyDADMAC is the abbreviation of poly(diallyldimethylammonium chloride) with a low mol weight; catalog nr. 52237-6, available from Aldrich Chemical Company, Inc., Milwaukee, Wis., USA.

Tallopol ACF is a product mixture of potassium and sodium salts of carbonic acids, available from Stockhausen, Krefeld, Germany.

TABLE B

Specific electrical resistance.

| | Experiment No. | | | | |
|---|---|---|---|---|---|
| | 1A | 1B | 1C | 1D | 1E |
| Finish composition applied with applicator | a1 | b1 | b1 | c1 | d1 |
| COS amount on yarn (wt. %) | 3.0 | 3.0 | 4.0 | 4.0 | 4.0 |
| Conductivity of a 50 wt. % finish composition in mS/cm at 20° C. | 42.6 | 43.7 | 43.7 | 45.4 | 215.0 |

TABLE B-continued

| Specific electrical resistance. | Experiment No. | | | | |
|---|---|---|---|---|---|
| | 1A | 1B | 1C | 1D | 1E |
| Specific electrical resistance of the yarn in Ohm · cm | 3.5E+03 | 6.5E+03 | 2.8E+03 | 2.8E+03 | 5.8E+02 |

COMPARATIVE EXAMPLE 1

This comparative example relates to an experiment in which the yarn of Example 1 was provided with 0.9 % of a non-ionic finish normally used for the spinning of Twaron® yarns. The conductivity of the finish solution (50 wt. %) was 0.009 mS/cm. The obtained yarn showed a specific electrical resistance of 7.2E+07 Ohm·cm.

EXAMPLE 2

This example illustrates the procedure of applying a finish containing a conductive organic substance (COS) to a dried yarn in an operation integrated with the spinning process. The spinning mass of Example 1 was extruded through a spinneret which had 2000 orifices of 59 micrometer in diameter and was thereafter successively passed through the same air zone, coagulation, neutralization, and washing bath as described in Example 1. Excess adhering water was removed with the aid of a squeeze roller pair. Next, the yarn was passed over a series of 3 drying drums (6 wraps of 160° C., 6 wraps of 180° C., 4 wraps of 250° C.). The yarn was in contact with the surface of the drums for about 7 seconds in all. Next, the completely dried bundle of filaments was provided with an aqueous finish containing a COS with the aid of a liquid applicator and a feed pump. Subsequently, the yarn was passed over a transport drum (4 wraps of about 20° C.) and was wound into a package at a speed of 300 m/min. The yarn obtained had a linear density of 3220 dtex. The following process conditions were varied (table C and D):

a) the composition of the finish containing the COS b) the amount of COS on yarn c) the concentration of the finish solution

TABLE C

| Aqueous finishes containing conductive organic substances. | Finish composition code | | |
|---|---|---|---|
| | a2 | b2 | d2 |
| Finish concentration in wt. % COS in solution (%) | 37.6 | 46.3 | 50 |
| Afilan V4855 (37.6%) | 100.0 | 86.1 | |
| Afilan PTU | | 13.9 | |
| Tallopol ACF (50.5%) | | | 99.0 |
| Demineralized water | | | 1.0 |

TABLE D

| The specific electrical resistance. | Experiment No. | | |
|---|---|---|---|
| | 2A | 2B | 2C |
| Finish composition applied with applicator | a2 | b2 | d2 |
| COS amount on yarn (wt. %) | 3.0 | 3.5 | 2.5 |
| Conductivity of a 50 wt. % finish composition in mS/cm at 20° C. | 42.6 | 43.7 | 215.0 |
| Specific electrical resistance of the yarn in Ohm · cm | 7.8E+03 | 7.2E+03 | 9.6E+02 |

EXAMPLE 3

This example illustrates the application of a finish containing a conductive organic substance (COS) to a dried yarn not directly coupled to the spinning process. Commercially available Twaron® 2200 (1610 dtex/f 1000) yarn was subjected to the following treatments. The yarn package was rollingly unwound while successively passing the yarn over a liquid applicator, through a steam box (temperature 240° C., residence time 8 seconds) and finally wound into a package at a speed of 75 m/min. With the liquid applicator and a feed pump, the yarn was coated with the finishes mentioned in table E and F. The following process conditions were varied:

a) the composition of the finish containing the COS b) the amount of COS on yarn c) the concentration of the finish solution.

TABLE E

| Aqueous finishes containing conductive organic substances. | Finish composition code | | | |
|---|---|---|---|---|
| | a3 | d3 | d4 | d1 |
| Finish concentration in wt. % COS in solution (%) | 15 | 10 | 15 | 20 |
| Afilan V4855 (37.6%) | 40.0 | | | |
| Tallopol ACF (50.5%) | | 19.8 | 29.7 | 39.6 |
| Demineralized water | 60.0 | 80.2 | 70.3 | 60.4 |

TABLE F

| The specific electrical resistance. | Experiment No. | | | |
|---|---|---|---|---|
| | 3A | 3B | 3C | 3D |
| Finish composition applied with applicator | a3 | d3 | d4 | d1 |

TABLE F-continued

The specific electrical resistance.

| | Experiment No. | | | |
|---|---|---|---|---|
| | 3A | 3B | 3C | 3D |
| COS amount on yarn (wt. %) | 2.5 | 2.0 | 3.0 | 4.0 |
| Conductivity of a 50 wt. % finish composition in mS/cm at 20° C. | 42.6 | 215.0 | 215.0 | 215.0 |
| Specific electrical resistance of the yarn in Ohm · cm | 3.9E+03 | 2.9E+03 | 1.8E+03 | 8.8E+02 |

EXAMPLE 4

This example illustrates the application of a finish containing a conductive organic substance (COS) to a dried yarn not directly coupled to the spinning process. Commercially available Twaron® 2200 (3220 dtex/f 2000) yarn was subjected to the following treatments. The yarn package was unwound while successively passing the yarn over a double rotating kiss-roll and through a hot air oven (temperature 180° C., residence time 18 seconds) and was finally wound into a package at a speed of 100 m/min. With the double kiss-roll the yarn was coated with the finishes mentioned in table G and H. The following process conditions were varied:

a) the composition of the finish containing the COS
b) the amount of COS on yarn
c) the concentration of the finish solution.

TABLE G

Aqueous finishes containing conductive organic substances.

| | Finish composition code | |
|---|---|---|
| | a1 | d4 |
| Finish concentration in wt. % | 20 | 15 |
| COS in solution (%) | | |
| Afilan V4855 (37.6%) | 53.2 | |
| Tallopol ACF (50.5%) | | 29.7 |
| Demineralized water | 46.8 | 70.3 |

TABLE H

The specific electrical resistance.

| | Experiment No. | |
|---|---|---|
| | 4A | 4B |
| Finish composition applied with applicator | a1 | d4 |
| COS amount on yarn (wt. %) | 10.3 | 5.6 |
| Conductivity of a 50 wt. % finish composition in mS/cm at 20° C. | 42.6 | 215.0 |
| Specific electrical resistance of the yarn in Ohm · cm | 3.5E+03 | 1.2E+03 |

EXAMPLE 5

This example illustrates the application of a finish containing COS to a dried and finish-free yarn not directly coupled to the spinning process. A package of finish-free Twaron® (1610 dtex/f 1000) yarn was subjected to the following treatments. The yarn package was unwound while successively passing the yarn over a liquid applicator, through a hot air oven (temperature 90° C., residence time 32 seconds) and was finally wound into a package at a speed of 50 m/min. With the liquid applicator and a feed pump, the yarn was coated with the finishes mentioned in table K and L. The following process conditions were varied:

a) the composition of the finish containing the COS
b) the amount of COS on yarn
c) the concentration of the finish solution.

TABLE K

Aqueous finishes containing conductive organic substances.

| | Finish composition code | | |
|---|---|---|---|
| | e1 | f1 | g1 |
| Finish concentration in wt. % | 20 | 32 | 20 |
| COS in solution (%) | | | |
| Leomin AN | 20.0 | 16.0 | |
| Leomin OR | | 16.0 | |
| Atlas G3634a | | | 20.0 |
| Demineralized water | 80.0 | 68.0 | 80.0 |

Leomin AN is an ethyl octane phosphonate, potassium salt; available from Clariant GmbH, Frankfurt, Germany.

Leomin OR is a polyglycol ester of a fatty acid, available from Clariant GmbH, Frankfurt, Germany.

Atlas G3634a is an imidazoline derivate, quarternized, available from Uniqema, Middlesbrough, England.

TABLE L

The specific electrical resistance.

| | Experiment No. | | |
|---|---|---|---|
| | 5A | 5B | 5C |
| Finish composition applied with applicator | e1 | f1 | g1 |
| COS amount on yarn (wt. %) | 5.0 | 8.0 | 5.0 |
| Conductivity of a 50 wt. % finish composition in mS/cm at 20° C. | 40.8 | 15.2 | 4.7 |
| Specific electrical resistance of the yarn in Ohm · cm | 2.2E+03 | 5.6E+03 | 2.2E+04 |

The invention claimed is:

1. An aramid filament yarn provided with a finish comprising >1.5 wt. % of an organic substance with a conductivity of >4 mS/cm, measured as a 50 wt. % finish composition in water at 20° C., the yarn with the finish having a specific electric resistance of $<2.5\cdot10^4$ Ohm·cm.

2. The aramid filament yarn of claim 1 provided with a finish comprising >2 wt. % of an organic substance with a conductivity of >30 mS/cm, measured as a 50 wt. % finish composition in water at 20° C., the yarn with the finish having a specific electric resistance of $<2\cdot10^3$ Ohm·cm.

3. The aramid filament yarn of claim 1 provided with a finish comprising >2 wt. % of an organic substance with a conductivity of >41 mS/cm, measured as a 50 wt. % finish composition in water at 20° C., the yarn with the finish having a specific electric resistance of $<10^3$ Ohm·cm.

4. A method of making the yarn of claim 1, comprising bringing a solution of an organic substance onto the aramid yarn such as to obtain >1.5 wt. % of the substance relative to a total weight of the yarn without the finish, wherein the organic substance has a conductivity of >4 mS/cm, measured as a 50 wt. % finish composition in water at 20° C.

5. The aramid filament yarn of claim 1, wherein the yarn transports electric current.

6. The aramid filament yarn of claim 5, wherein the yarn transports electric current in aramid-containing material.

7. The aramid filament yarn of claim 5, wherein the yarn is incorporated into an elevator cable.

8. The aramid filament yarn of claim 5, wherein the yarn is incorporated into an elevator cable consisting essentially of aramid yarn.

9. A cable consisting essentially of aramid yarn and at least one aramid filament yarn provided with a finish comprising >1.5 wt. % of an organic substance with a conductivity of >4 mS/cm, measured as a 50 wt. % finish composition in water at 20° C., the at least one aramid filament yarn with the finish having a specific electric resistance of $<2.5 \cdot 10^4$ Ohm·cm.

10. The cable of claim 9, wherein the cable is an elevator cable.

11. The aramid filament yarn of claim 2 provided with a finish comprising >2 wt. % of an organic substance with a conductivity of >41 mS/cm, measured as a 50 wt. % finish composition in water at 20° C., the yarn with the finish having a specific electric resistance of $<10^3$ Ohm·cm.

12. The aramid filament yarn of claim 2, wherein the yarn transports electric current.

13. The aramid filament yarn of claim 12, wherein the yarn transports electric current in aramid-containing material.

14. The aramid filament yarn of claim 12, wherein the yarn is incorporated into an elevator cable.

15. The aramid filament yarn of claim 12, wherein the yarn is incorporated into an elevator cable consisting essentially of aramid yarn.

16. The aramid filament yarn of claim 3, wherein the yarn transports electric current.

17. The aramid filament yarn of claim 16, wherein the yarn transports electric current in aramid-containing material.

18. The aramid filament yarn of claim 16, wherein the yarn is incorporated into an elevator cable.

19. The aramid filament yarn of claim 16, wherein the yarn is incorporated into an elevator cable consisting essentially of aramid yarn.

* * * * *